US010982900B2

(12) United States Patent
Marinitsch et al.

(10) Patent No.: US 10,982,900 B2
(45) Date of Patent: Apr. 20, 2021

(54) THERMAL PROCESSING OF BULK SOLIDS

(71) Applicant: SOLEX THERMAL SCIENCE INC., Calgary (CA)

(72) Inventors: Gerald Marinitsch, Kalsdorf bei Graz (AT); Francisco José Castellano Gassó, Úbeda (ES); Caroline Richard, Calgary (CA)

(73) Assignee: SOLEX THERMAL SCIENCE INC., Calgary (CA)

( * ) Notice: Subject to any disclaimer, the term of this patent is extended or adjusted under 35 U.S.C. 154(b) by 118 days.

(21) Appl. No.: 16/517,375

(22) Filed: Jul. 19, 2019

(65) Prior Publication Data

US 2021/0018266 A1 Jan. 21, 2021

(51) Int. Cl.

| | |
|---|---|
| ***F26B 21/06*** | (2006.01) |
| ***F26B 17/16*** | (2006.01) |
| ***F26B 17/14*** | (2006.01) |
| ***F26B 3/20*** | (2006.01) |

(52) U.S. Cl.
CPC ..... *F26B 17/16* (2013.01); *F26B 3/20* (2013.01); *F26B 17/145* (2013.01)

(58) Field of Classification Search
CPC ..... F26B 17/16; F26B 17/145; F26B 3/20
USPC ..... 34/191, 489, 488, 492, 505
See application file for complete search history.

(56) References Cited

U.S. PATENT DOCUMENTS

| | | | | |
|---|---|---|---|---|
| 3,397,460 | A | 8/1968 | Hall | |
| 3,967,464 | A * | 7/1976 | Cormier | F25J 3/04169 62/650 |
| 4,292,743 | A | 10/1981 | Razus | |
| 4,424,634 | A | 1/1984 | Westelaken | |
| 4,679,620 | A | 7/1987 | Daun | |
| 5,167,274 | A | 12/1992 | Mueller | |
| 6,328,099 | B1 | 12/2001 | Hilt et al. | |
| RE37,653 | E | 4/2002 | Anderson | |
| 7,950,376 | B2 * | 5/2011 | Rollet | F02M 26/30 123/568.12 |
| 8,578,624 | B2 | 11/2013 | Jordison et al. | |

(Continued)

FOREIGN PATENT DOCUMENTS

| | | | |
|---|---|---|---|
| CA | 1266772 | A | 3/1990 |
| CA | 2305838 | A1 | 10/2000 |

(Continued)

OTHER PUBLICATIONS

International Patent Application No. PCT/CA2019/051003, International Search Report dated Aug. 20, 2019.

*Primary Examiner* — John P McCormack
(74) *Attorney, Agent, or Firm* — Borden Ladner Gervais LLP; Geoffrey deKleine

(57) ABSTRACT

An apparatus for drying or conditioning bulk solids, includes a housing including an inlet for receiving the bulk solids, and an outlet for discharging the bulk solids, a plurality of spaced apart heat transfer plates assemblies disposed in the housing between the inlet and the outlet for passage of the bulk solids that flow from the inlet, through spaces between the heat transfer plates, and a sweep gas delivery system for the flow of sweep gas in a first direction across the direction of flow of the bulk solids. The sweep gas delivery system includes at least one valve for reversing the flow of the sweep gas from the first direction to a second direction, opposite to the first direction.

19 Claims, 8 Drawing Sheets

(56) References Cited

U.S. PATENT DOCUMENTS

| | | | | |
|---|---|---|---|---|
| 2011/0287159 | A1* | 11/2011 | Hassan | A23B 7/153<br>426/602 |
| 2015/0225649 | A1* | 8/2015 | Kellens | C10L 5/44<br>202/99 |
| 2016/0076813 | A1* | 3/2016 | Skold | F28C 3/14<br>34/505 |

FOREIGN PATENT DOCUMENTS

| | | | |
|---|---|---|---|
| CA | 2650601 | A1 | 11/2007 |
| DE | 3317204 | C1 | 10/1984 |
| JP | 2001041655 | A | 2/2001 |
| WO | 03001131 | A1 | 1/2003 |

* cited by examiner

THERMAL PROCESSING OF BULK SOLIDS

FIELD OF THE INVENTION

The present disclosure relates to the thermal processing for drying or conditioning bulk solids such as soybeans, canola, or sunflower seeds.

BACKGROUND

Drying or conditioning materials such as soybeans, canola, sunflower seeds, and other bulk solids is desirable. Dryers that utilize hot air to pick up moisture, which is then vented, may be utilized but such dryers are inefficient.

Higher air temperatures improve drying efficiency but the air temperature is limited by the material being dried. In particular, materials such as soybeans, canola, and sunflower seeds degrade with temperatures that are too high. In the example of soybeans, low drying temperatures are desirable to reduce moisture content without causing cracking of the soybeans. In addition, significant heat is lost when the hot air is vented after picking up moisture.

Dryers utilizing steam-filled tubes or heated plates may be utilized but such dryers require a purge or sweep air to absorb water vapor and carry the water vapor out of the dryer. Large quantities of air are therefore required to remove the moisture.

Efficiency of heating and control of drying temperatures and residence time in the dryer are desirable. Further improvements in bulk solids dryers or conditioners are therefore desirable.

SUMMARY

According to an aspect of an embodiment, an apparatus for drying or conditioning bulk solids is provided. The apparatus includes a housing including an inlet for receiving the bulk solids, and an outlet for discharging the bulk solids. A plurality of spaced apart heat transfer plates assemblies are disposed in the housing between the inlet and the outlet for passage of the bulk solids that flow from the inlet, through spaces between the heat transfer plates. The apparatus also includes a sweep gas delivery system for the flow of sweep gas in a first direction across the direction of flow of the bulk solids, the sweep gas delivery system including at least one valve for reversing the flow of the sweep gas from the first direction to a second direction, opposite to the first direction.

According to another aspect of an embodiment, a method of drying or conditioning bulk solids is provided. The method includes introducing the bulk solids into an inlet of a housing through which the bulk solids flow through spaces between spaced apart heat transfer plates, subjecting the bulk solids to heating utilizing the heat transfer plates as the bulk solids flow, by the force of gravity, through the spaces between the heat transfer plates, toward an outlet of the housing, directing a sweep gas through the bulk solids as the bulk solids flow toward the outlet of the housing, the sweep gas being directed to flow in a first direction across the direction of flow of the bulk solids, and reversing direction of flow of the sweep gas by directing the flow of the sweep gas through the bulk solids, in a second direction opposite to the first direction.

BRIEF DESCRIPTION OF THE DRAWINGS

Embodiments of the present invention will be described, by way of example, with reference to the drawings and to the following description, in which.

DETAILED DESCRIPTION OF THE PREFERRED EMBODIMENTS

Figure 1:
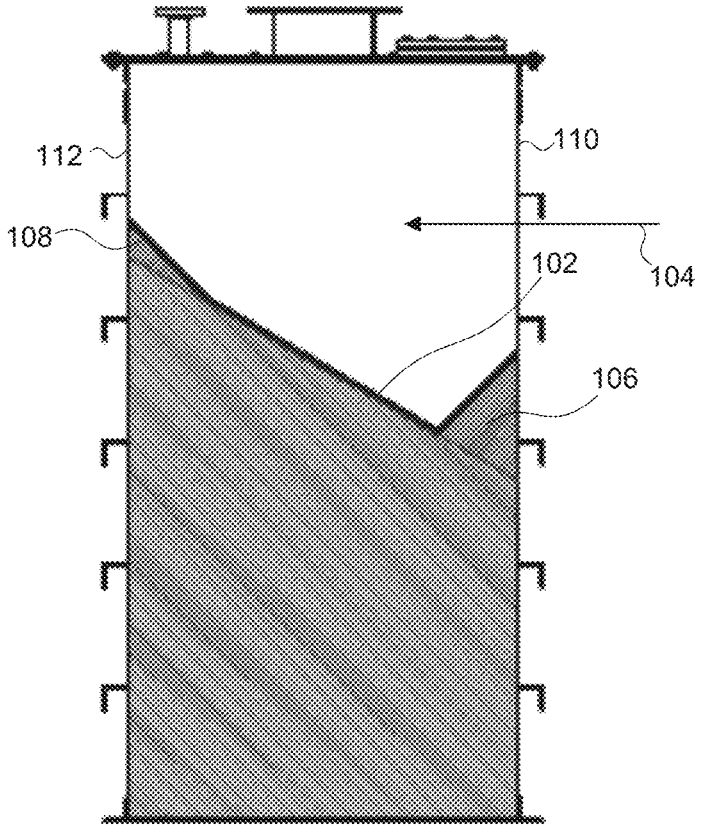
FIG. 1 is a simplified representation of an interior of an example of a dryer, illustrating mass flow profile in the dryer.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, known methods, procedures, and components have not been described in detail to avoid obscuring the embodiments described. The description is not to be considered as limited to the scope of the embodiments described herein.

As stated hereinabove, dryers utilizing steam-filled tubes or heated plates require a purge or sweep air to absorb water vapor and carry the water vapor out of the dryer. Large quantities of air are therefore required to remove the moisture. A significant pressure drop occurs as large quantities of air is pumped through a dryer, for example, from bottom toward the top of the dryer as the air must pass through the bulk solids being dried. As a result, high pressures are required to continue to move air through the dryer.

Rather than passing air upwardly through the dryer, the air may be passed across the dryer, generally transverse to the direction of flow of the bulk solids. The air pumped through the dryer, however, introduces significant differences in mass flow from one side to the other. FIG. 1 is a simplified representation of an interior of an example of a dryer, illustrating the mass flow profile 102 in the dryer. The airflow is illustrated by the arrow 104. As illustrated, drag effects 106, 108 along the side walls 110, 112 reduce the flow rate of bulk solids immediately adjacent the walls. The bulk solids, however, flow at a faster rate near the side wall 110 at which the air enters the dryer compared to the rate at which the bulk solids flow near the side wall 112 at which the air exits the dryer. This effect is a result of the generally horizontal air movement across the bulk solids. The mass flow profile illustrated affects residence time in the dryer, with a significant difference in residence time across the dryer. Control and consistency of residence time in the dryer, however, is desirable.

Figure 2:
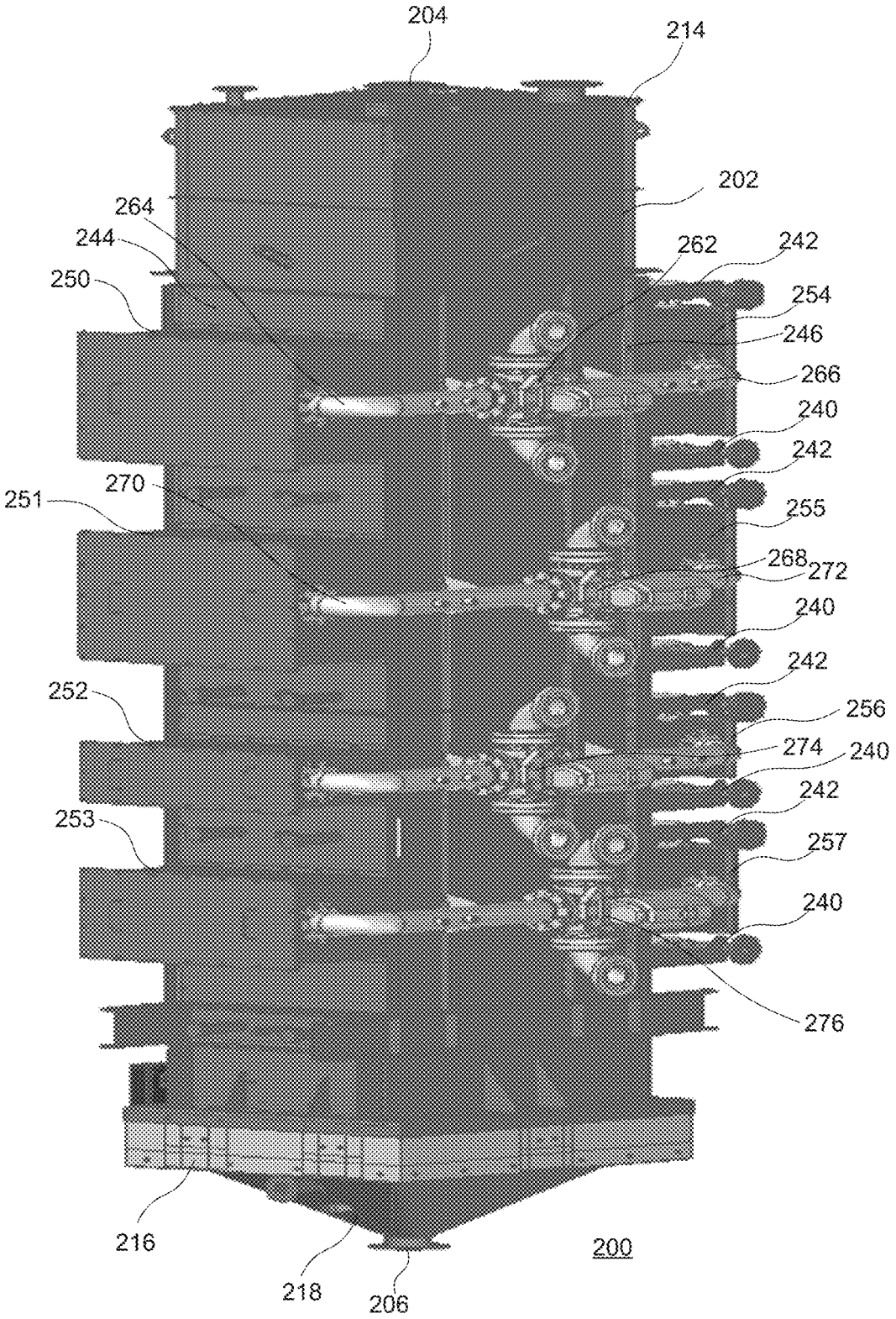
FIG. 2 is a perspective view of a dryer in accordance with an embodiment.
Figure 3:
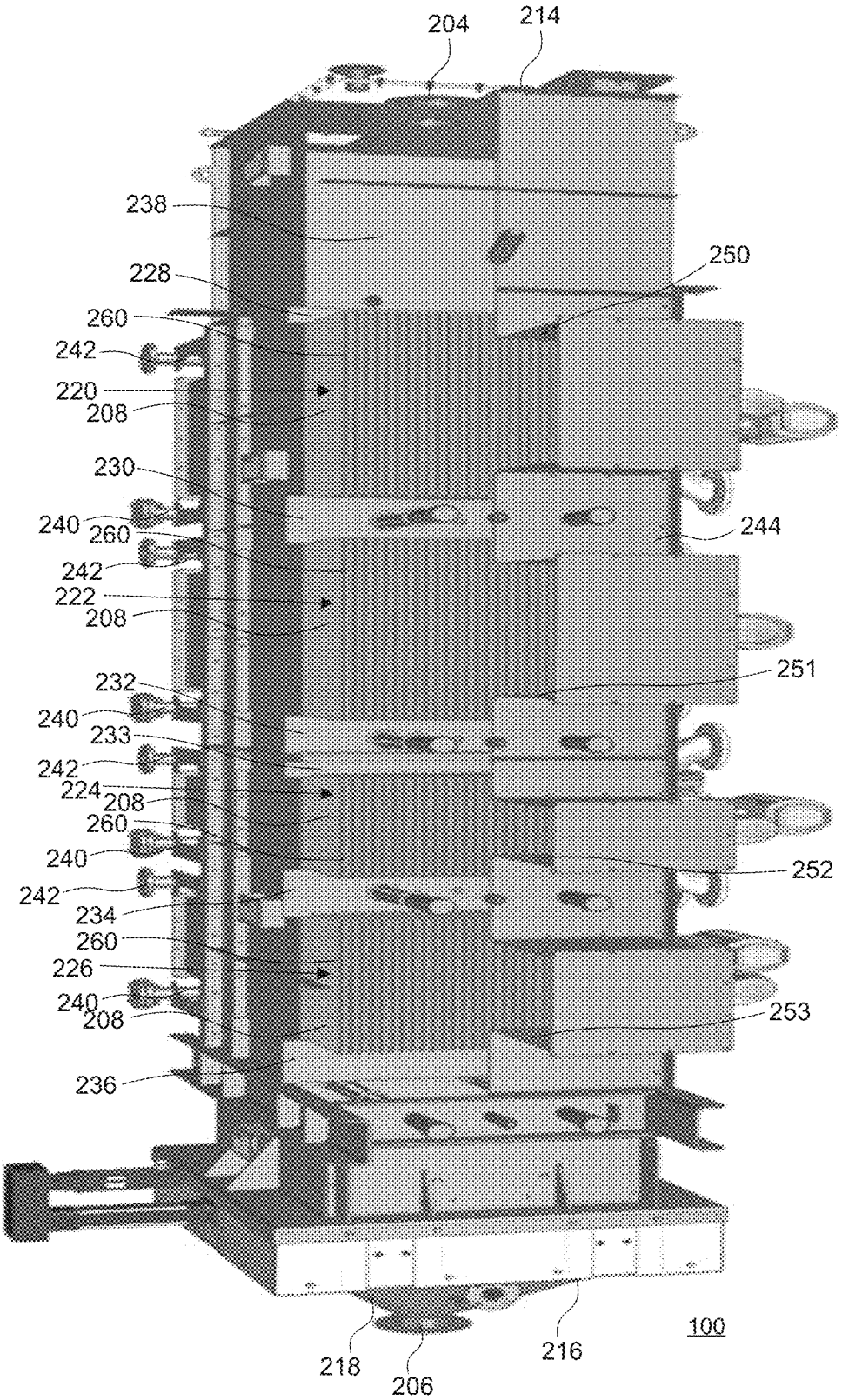
FIG. 3 is another perspective view of the dryer of FIG. 2 with a portion of the housing cut away to show the heat transfer plates for the purpose of explanation.
Figure 4:
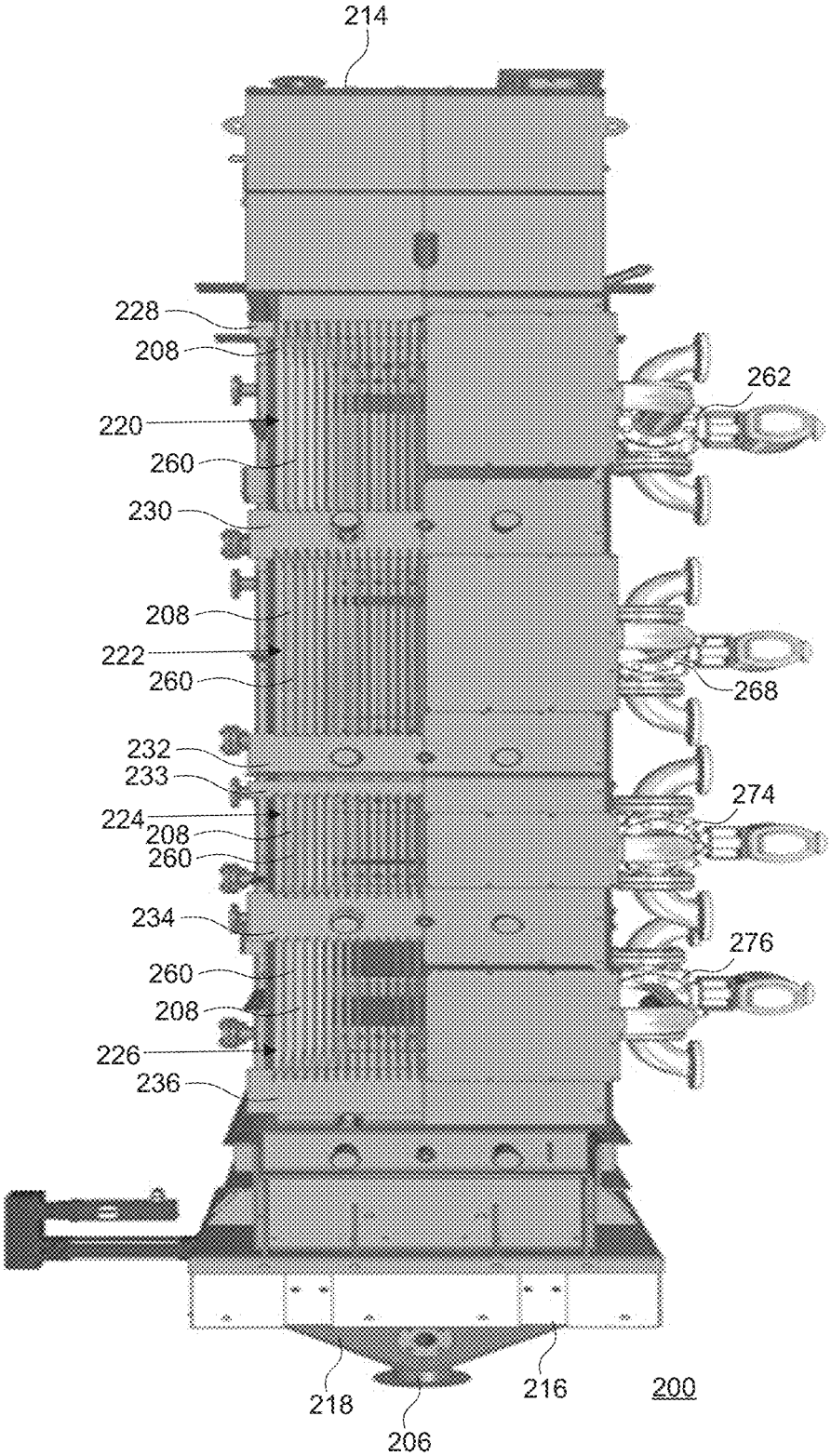
FIG. 4 is a side view of the dryer of FIG. 2 with a portion of the housing cut away.

Referring to FIG. 2 through FIG. 4, the disclosure generally relates to a method and an apparatus for drying or conditioning bulk solids. The apparatus 200 includes a housing 202 including an inlet 204 for receiving the bulk solids, and an outlet 206 for discharging the bulk solids. A plurality of spaced apart heat transfer plates 208 are disposed in the housing 202 between the inlet 204 and the outlet 206 for passage of the bulk solids that flow from the inlet 204, through spaces between the heat transfer plates 208. The apparatus 200 also includes a sweep gas delivery system 210 (shown in FIG. 5 and FIG. 6) for the flow of sweep gas in a first direction across the direction of flow of the bulk solids. The sweep gas delivery system includes at least one valve for reversing the flow of the sweep gas from the first direction to a second direction, opposite to the first direction.

A perspective view of an apparatus, which in the present embodiment is a dryer, and partially cut away views of the dryer are shown in FIG. 2 through FIG. 4. The apparatus 200 includes the housing 202, which has a generally rectangular cross-section. The housing 202 has a top 214 and a bottom 216. The top 214 of the housing 202 includes the inlet 204 for introducing bulk solids into the housing 202. The bottom 216 of the housing 202 provides a discharge hopper 218, which includes the outlet 206 for discharging the bulk solids from the housing 202. A generally vertical axis extends from a center of the inlet 204 to a center of the outlet 206. A plurality of heat transfer plates 208 are disposed within the housing 202, between the inlet 204 and the outlet 206. The plurality of heat transfer plates 208 are horizontally spaced apart along axes that extend transverse to the vertical axis and the heat transfer plates 208 are arranged generally parallel to each other in rows, referred to herein as banks.

In the example shown in FIG. 2 through FIG. 4, the apparatus 200 includes four banks of heat transfer plates 208. The four banks are arranged in a stack. The stack includes a top bank 220, a bottom bank 226, and two intermediary banks, referred to as the second bank 222 and the third bank 224, located between the bottom bank 226 and the top bank 220. For the purpose of the present example, each heat transfer plate bank includes a plurality of the heat transfer plates 208. Although the apparatus 200 of FIG. 2 through FIG. 4 includes four banks, other suitable numbers of banks may be utilized. For example, the apparatus may include a single bank of heat transfer plates 208. Other numbers of banks of heat transfer plates may be successfully implemented. Also, other suitable numbers of heat transfer plates 208 in each heat transfer plate bank may be utilized.

The banks 220, 222, 224, 226 of heat transfer plates 208 are spaced apart. The heat transfer plates 208 of the top bank 220 are spaced apart by spacers 228 and by the spacers 230, which also support the top bank 220 of heat transfer plates 208. The heat transfer plates 208 of the second bank 222 are spaced apart by the spacers 230 and by the spacers 232, which also support the second bank 222. The third bank 224 of heat transfer plates 208 are spaced apart by the spacers 233 and by the spacers 234, which also support the third bank 224. The bottom bank 226 of heat transfer plates 208 are spaced apart by the spacers 234 and by the spacers 236, which also support the bottom bank 226 of heat transfer plates 208. The spacers 236 support the bottom bank 226 of heat transfer plates 208 and the weight of the bulk solids introduced into the apparatus 200 as the weight of the bulk solids is transferred to the heat transfer plates 208 via friction.

The top bank 220 of heat transfer plates 208, which is the bank that is located closest to the inlet 204, is sufficiently spaced from the inlet 204 to provide a hopper 238 in the housing 202, between the inlet 204 and the top bank 220. The hopper 238 facilitates distribution of bulk solids that flow from the inlet 204, as a result of the force of gravity, over the heat transfer plates 208 of the top bank 220 and into spaces between adjacent heat transfer plates 208 of the top bank 220. The bottom bank 226 of the stack, which is the bank that is located closest to the outlet 206, is sufficiently spaced from the outlet to facilitate the flow of bulk solids through the outlet 206. The discharge hopper 218 is utilized to create a mass flow or "choked flow" of bulk solids and to regulate the flow rate of the bulk solids through the apparatus 200. An example of a discharge hopper is described in U.S. Pat. No. 5,167,274, the entire content of which is incorporated herein by reference. The term "choked flow" is utilized herein to refer to a flow other than a free fall of the bulk solids as a result of the force of gravity.

The apparatus 200 also includes fluid inlet manifolds 240 that provide heating fluid to the heat transfer plates 208, and fluid discharge manifolds 242 that receive the heating fluid from the heat transfer plates. In the present example, each of the banks 220, 222, 224, 226 of heat transfer plates 208 is coupled to a respective fluid inlet manifold 240 and a respective fluid discharge manifold 242. The fluid inlet manifold 240 coupled to the top bank 220 of heat transfer plates 208 is coupled to the housing 202 and is in fluid communication with each heat transfer plate 208 of the top bank 220. A respective fluid line extends from each heat transfer plate 208 of the top bank 220 to the respective fluid inlet manifold 240. The fluid discharge manifold 242 coupled to the top bank 220 of heat transfer plates 208, is coupled to the housing 202, and is in fluid communication with each heat transfer plate 208 of the top bank 220. A respective fluid line extends from each heat transfer plate 208 of the top bank 220 to the fluid discharge manifold 242. Similarly, each of the second bank 222, the third bank 224, and the bottom bank 226 are coupled to a respective fluid inlet manifold 240 and a respective fluid discharge manifold 242.

In this example, each of the banks 220, 222, 224, 226 of heat transfer plates 208 is coupled to a respective fluid inlet manifold 240 and a respective fluid discharge manifold 242. Alternatively, banks of heat transfer plates may share a fluid inlet manifold and a fluid discharge manifold. For example, a respective fluid line may extend from each heat transfer plate of two or more banks of plates to a fluid inlet manifold and a respective fluid line may extend from each heat transfer plate of the two or more banks of plates to a fluid discharge manifold. Alternatively, heat transfer plates may be interconnected such that, for example, a respective fluid line extends from the fluid inlet manifold to each heat transfer plate of one bank, and each heat transfer plate of the one bank is coupled by a fluid line to respective heat transfer plates of an adjacent bank. Each heat transfer plate of the adjacent bank may then be coupled by a respective fluid line to the fluid discharge manifold.

Each heat transfer plate 208 of each bank 220, 222, 224, 226 generally extends the width of the housing 202, between a first sidewall 244 of the housing 202 and an opposing second sidewall 246 of the housing 202. The heat transfer plates 208 are horizontally spaced apart and arranged generally parallel to each other such that spaces are provided between adjacent heat transfer plates 208.

Optionally, the heat transfer plates 208 of any one of the banks 220, 222, 224, 226 may be horizontally offset, i.e., not vertically aligned, with the heat transfer plates 208 of any of the other banks 220, 222, 224, 226. Thus, the heat transfer plates 208 of the top bank 220 may be horizontally offset from the heat transfer plates 208 of the second bank 222. Similarly, the heat transfer plates 208 of the second bank 222 may be horizontally offset from the heat transfer plates 208 of the third bank 224. The heat transfer plates 208 may of the third bank 224 may be horizontally offset from the heat transfer plates 208 of the bottom bank 226.

Each bank 220, 222, 224, 226 of heat transfer plates 208 is provided with a pair of sweep gas plenums located on opposing sides of the housing 202 for the flow of sweep gas across the direction of flow of the bulk solids as the bulk solids pass through the spaces between the heat transfer plates 208. The sweep gas plenums include first sweep gas plenums 250, 251, 252, 253 on the first sidewall 244 of the housing 202 and second sweep gas plenums 254, 255, 256, 257 on the second sidewall 246 of the housing 202, which is opposite to the first sidewall 244.

Each first sweep gas plenum 250, 251, 252, 253 has an air pervious side adjacent to end edges 260 of the heat transfer plates 208 of the associated bank of heat transfer plates 208. The air pervious side of the first sweep gas plenum 250, 251, 252, 253 facilitates the flow of sweep gas from the first sweep gas plenum 250, 251, 252, 253 into the spaces between the heat transfer plates 208 and from the spaces between the heat transfer plates 208 into the first sweep gas plenum 250, 251, 252, 253. The air pervious side of the first sweep gas plenum 250, 251, 252, 253 may be made of any suitable material that allows the passage of sweep gas through the air pervious side while inhibiting passage of bulk solids into the first sweep gas plenum 250, 251, 252, 253.

The second sweep gas plenums 254, 255, 256, 257 have an air pervious side adjacent to opposite end edges of the heat transfer plates 208 of the associated bank of heat transfer plates 208. The air pervious side of the second sweep gas plenum 254, 255, 256, 257 facilitates the flow of sweep gas from the spaces between the heat transfer plates 208 into the second sweep gas plenum 254, 255, 256, 257 and from the second sweep gas plenum 254, 255, 256, 257 into the spaces between the heat transfer plates 208. The air pervious side of the second sweep gas plenum 254, 255, 256, 257 may be made of any suitable material that allows the passage of sweep gas through the air pervious side while inhibiting passage of bulk solids into the second sweep gas plenum 254, 255, 256, 257.

In the present example, the first sweep gas plenum 250 and the second sweep gas plenum 254 associated with the top bank 220 of heat transfer plates 208 are coupled to respective ports of a four-port valve 262 by ducting. Thus, first ducting 264 extends from the first sweep gas plenum 250 to the four-port valve 262 and second ducting 266 extends from the second sweep gas plenum 254 to the four-port valve 262. The four-port valve 262 is coupled, via a third port, to a sweep gas source, such as a fan or blower for blowing sweep gas in a direction generally across the direction of flow of the bulk solids. The four-port valve 262 is also coupled, via a fourth port, to a sweep gas draw, such as a fan or blower for drawing sweep gas out of the housing 202.

The four-port valve 262 is operable to be switched between a first flow configuration and a second flow configuration. The four-port valve 262 controls the flow of the sweep gas to cause the sweep gas to flow in a first direction, through the first sweep gas plenum 250, through the spaces between the heat transfer plates 208, and out of the second sweep gas plenum 254 when the four-port valve is in the first flow configuration. The four-port valve 262 also controls the flow of the sweep gas to cause the sweep gas to flow in a second direction, opposite to the first direction when the four-port valve 262 is in the second flow configuration. Thus, the sweep gas flows through the second sweep gas plenum 254, through the spaces between the heat transfer plates 208, and out of the first sweep gas plenum 250 when the four-port valve 262 is in the second flow configuration.

Figure 6:
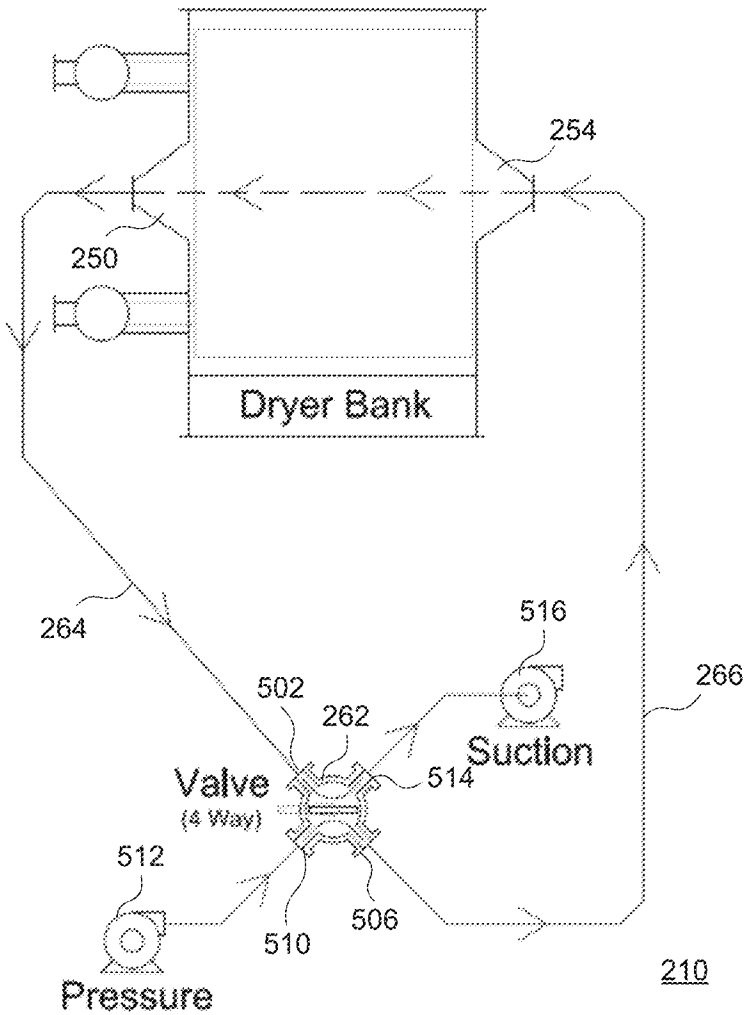
FIG. 5 and FIG. 6 are schematic representations of a portion of a dryer including a sweep gas delivery system.
Figure 5:
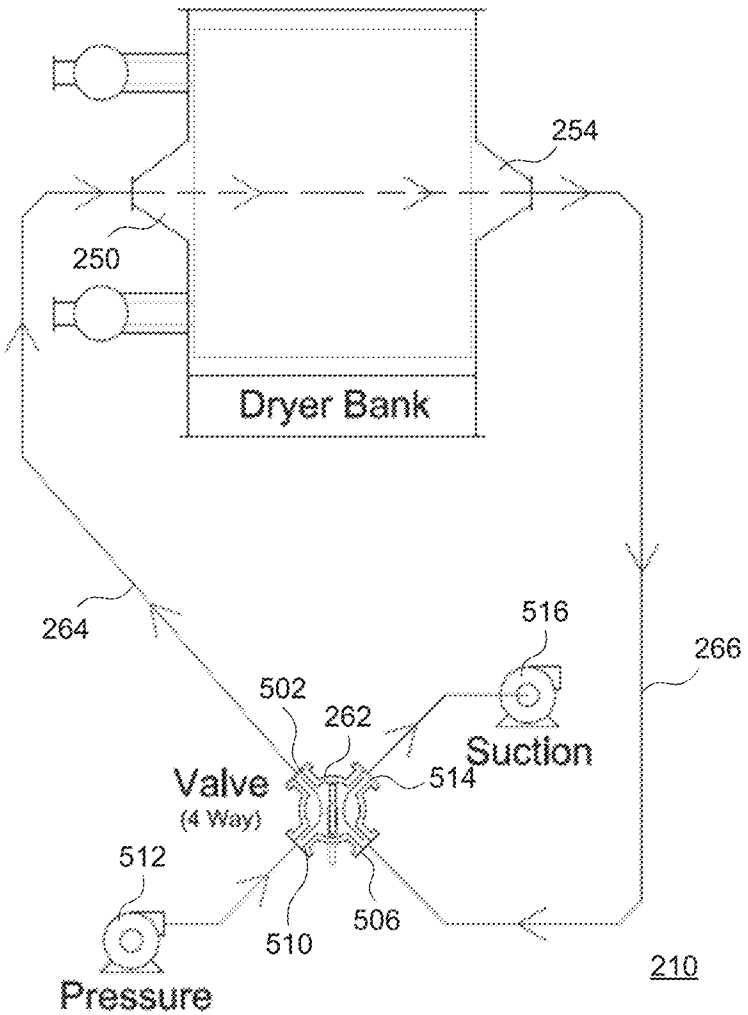

FIG. 5 and FIG. 6 are schematic representations of a portion of an apparatus, which in this example may be a dryer, including a sweep gas delivery system 210 and a bank of heat transfer plates. For the purpose of the present example, the portion of the dryer includes the top bank 220 of heat transfer plates 208. It will be understood, however, that the bank of heat transfer plates illustrated in FIG. 5 and FIG. 6 may be any bank of heat transfer plates.

In the schematic representation, the first sweep gas plenum 250 is coupled to the first port 502 of the four-port valve 262 by the ducting 264 and the second sweep gas plenum 254 is coupled to the second port 506 of the four-port valve 262 by the ducting 266. The four-port valve 262 is coupled, via a third port 510, to the sweep gas source 512 for blowing sweep gas in a direction generally across the direction of flow of the bulk solids. The four-port valve 262 is also coupled, via the fourth port 514, to a sweep gas draw 516 to provide suction for drawing sweep gas out of the housing.

The four-port valve 262 is shown in FIG. 5 in the first flow configuration in which the sweep gas source 512 is coupled to the first sweep gas plenum 250 for blowing sweep gas into the housing through the first sweep gas plenum 250. In the first flow configuration, the sweep gas draw 516 is coupled to the second sweep gas plenum 254 to draw sweep gas out of the housing via the second sweep gas plenum 254.

The fourth port 514 that is coupled to the sweep gas draw 516 is located physically lower or below the third port 510 that is coupled to the sweep gas source 512. The location of the fourth port 514 relatively lower or below the third port 510 facilitates the flow of condensate toward the fourth port 514 via gravity, for the reduction of condensate, for example, utilizing a condensate collector.

In the schematic of FIG. 6, the four-port valve 262 is shown in the second flow configuration in which the sweep gas source 512 is coupled to the second sweep gas plenum 254 for blowing sweep gas into the housing through the second sweep gas plenum 254. In the second flow configuration, the sweep gas draw 516 is coupled to the first sweep gas plenum 250 to draw sweep gas out of the housing via the first sweep gas plenum 250.

Although a four-port valve is shown in FIG. 5 and FIG. 6 and is described herein in relation to each bank of heat transfer plates, more than one valve may be utilized. Thus, any suitable number of valves may be utilized to facilitate switching between the first configuration and the second configuration.

Referring again to FIG. 2 through FIG. 4, the first sweep gas plenum 251 and the second sweep gas plenum 255 associated with the second bank 222 of heat transfer plates 208 are coupled to respective ports of a four-port valve 268 by ducting. Thus, first ducting 270 extends from the first sweep gas plenum 251 to the four-port valve 268 and second ducting 272 extends from the second sweep gas plenum 255 to the four-port valve 268. The four-port valve 268 is coupled, via a third port, to a sweep gas source, such as a pump or blower for blowing sweep gas in a direction generally across the direction of flow of the bulk solids. The four-port valve 268 is also coupled, via a fourth port, to a sweep gas draw, such as a pump for drawing sweep gas out of the housing 202.

The four-port valve 268 is operable to be switched between a first flow configuration and a second flow configuration. The four-port valve 268 controls the flow of the sweep gas to cause the sweep gas to flow in a first direction, in through the first sweep gas plenum 251, through the spaces between the heat transfer plates 208, and out of the second sweep gas plenum 255 when the four-port valve is in the first flow configuration. The four-port valve 268 also controls the flow of the sweep gas to cause the sweep gas to flow in a second direction, opposite to the first direction when the four-port valve 268 is in the second flow configuration.

Similarly, the first sweep gas plenum 252 and the second sweep gas plenum 256 associated with the third bank 224 of heat transfer plates 208 are coupled to respective ports of a four-port valve 274 by ducting. The four-port valve 274 is also coupled, via a third port, to a sweep gas source and, via a fourth port, to a sweep gas draw for drawing sweep gas out of the housing 202. The four-port valve 274 is operable to be switched between a first flow configuration and a second flow configuration. In the first flow configuration, sweep gas flows in the first direction, from the first sweep gas plenum 252, and out the second sweep gas plenum 256. In the second flow configuration, sweep gas flows in the second direction, opposite to the first direction.

The first sweep gas plenum 253 and the second sweep gas plenum 257 associated with the bottom bank 226 of heat transfer plates 208 are coupled to respective ports of a four-port valve 276 by ducting. The four-port valve 276 is also coupled, via a third port, to a sweep gas source and, via a fourth port, to a sweep gas draw for drawing sweep gas out of the housing 202. The four-port valve 276 is operable to be switched between a first flow configuration and a second flow configuration. In the first flow configuration, sweep gas flows in the first direction, from the first sweep gas plenum 253, and out the second sweep gas plenum 257. In the second flow configuration, sweep gas flows in the second direction, opposite to the first direction.

In the examples shown and described herein, each four-port valve is coupled to a sweep gas source for blowing sweep gas in a direction generally across the direction of flow of the bulk solids and to a sweep gas draw to provide suction for drawing sweep gas out of the housing. Alternatively, both the sweep gas source and sweep gas draw may be provided by a single fan or blower. In addition, a single valve may be utilized to control the flow of sweep gas across all of the banks of heat transfer plates 208 such that the valve controls the flow configuration for all of the banks. Thus, a single valve is operable to be switched between a first flow configuration and a second flow configuration for all of the banks. In this example, all of the sweep gas plenums are coupled to a single valve.

Figure 7:
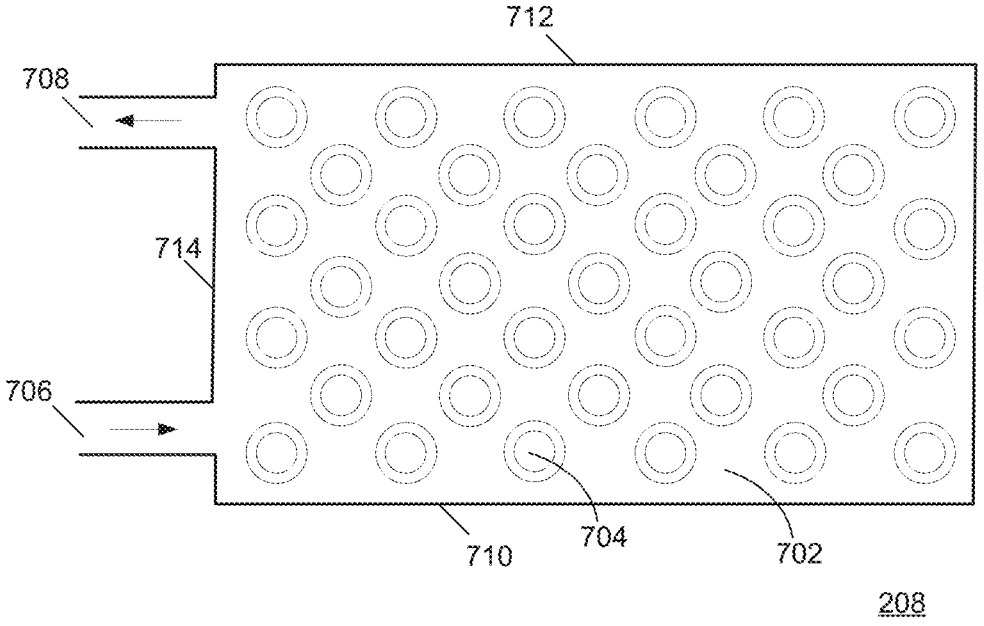
FIG. 7 is a side view of a heat transfer plate utilized in the dryer of FIG. 2.

FIG. 7 is a side view of a heat transfer plate 208 utilized, for example, in the apparatus 200 shown in FIG. 2 through FIG. 4. The heat transfer plate 208 includes a pair of metal sheets 702. The sheets 702 may be made from stainless steel, such as 316L stainless steel. The sheets 702 are arranged generally parallel to each other. The sheets 702 are welded together at locations that are spaced from the edges of the sheets 702 and are seam welded along the edges of the sheets 702. After the two sheets 702 are welded together, slots are cut for insertion of nozzles that are welded to the sheets 702 and are utilized as a fluid inlet 706 and a fluid outlet 708. The sheets 702 are inflated utilizing the nozzles such that generally circular depressions 704 are formed on each sheet at the welded locations. The generally circular depressions 704 are distributed throughout each sheet 702 and may be located at complementary locations on each sheet 702 such that the generally circular depressions 704 on one of the sheets 702 are aligned with the generally circular depressions 704 on the other of the sheets 702. When the sheets 702 are inflated, spaces are formed between the sheets 702, in areas where the sheets 702 are not welded together.

The fluid inlet 706 extends from a front edge 714, near a bottom 710 of the heat transfer plate 208. The fluid outlet 708 extends from the front edge 714, near a top 712 of the heat transfer plate 208. The fluid inlet 706 and the fluid outlet 708 both extend substantially perpendicular to and away from the front edge 714 of the heat transfer plate 208.

The flow of heating fluid through a heat transfer plate 208 is illustrated by the arrows in FIG. 7. In operation, heating fluid flows from the fluid inlet manifold 240 through the respective fluid lines, through the fluid inlet 706 and into the respective heat transfer plates 208. For the purposes of explanation, the flow of heating fluid through one of the heat transfer plates 208 is described with reference to FIG. 4.

The heating fluid flows through the fluid inlet 706 and into the heat transfer plate 208. The generally circular depressions 704 distributed throughout the heat transfer plate 208 facilitate the flow of the heating fluid throughout the heat transfer plate 208. The heating fluid then flows from the heat transfer plate 208 into the fluid outlet 708 and into the fluid discharge manifold 242 associated with that bank of heat transfer plates 208.

In the above-described example, each of the banks 220, 222, 224, 226 of heat transfer plates 208 is coupled to a respective fluid inlet manifold 240 and a respective fluid discharge manifold 242. Alternatively, banks of heat transfer plates may share a fluid inlet manifold and a fluid discharge manifold. For example, the heating fluid may flow from the fluid outlet 708 of each heat transfer plate 208 of the bottom bank 226, through the respective fluid lines, into the respective fluid inlets 706 of the heat transfer plates 208 of the third bank 224. Similarly, the fluid outlets 708 of heat transfer plates 208 of the third bank 224 may be fluidly coupled to the fluid inlets 706 of heat transfer plates 208 of the second bank 222. The fluid outlets 708 of heat transfer plates 208 of the second bank 222 may be fluidly coupled to the fluid inlets 706 of heat transfer plates 208 of the top bank 220. In this alternative, the heating fluid then flows from the fluid outlet 708 of each heat transfer plate 208 of the top bank 220 and into a fluid discharge manifold.

Optionally, the heating fluid may flow in the opposite direction to that illustrated in FIG. 7. For example, the fluid inlet 706 and the fluid outlet 708 may be reversed such that the fluid flows in near a top edge of the heat transfer plate 208 and flows out closer to a bottom edge of the heat transfer plate 208. The heating fluid may also flow downwardly from bank to bank in the apparatus.

Figure 8:
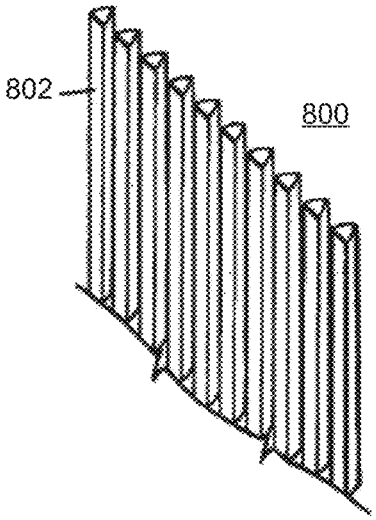
FIG. 8 is a perspective view of an air pervious portion of a dryer according to one example.

As indicated above, the air pervious side of each second sweep gas plenum 254, 255, 256, 257 may be of any suitable material that allows the passage of sweep gas through the air pervious side while inhibiting passage of bulk solids into the second sweep gas plenum 254, 255, 256, 257. For example, the air pervious side may be formed of wedge-wire screens 800 as illustrated in FIG. 8. The screens 800 include elongate members 802 that have generally triangular or V-shaped cross sections. The elongate members 802 are spaced apart a suitable distance and together inhibit bulk solids from passing through the spaces between the elongate members 802 while facilitating flow of sweep gas therethrough. The elongate members 802 are located such that a generally smooth surface is formed by faces of the members 802 and the generally smooth surface faces the bulk solids.

Figure 9:
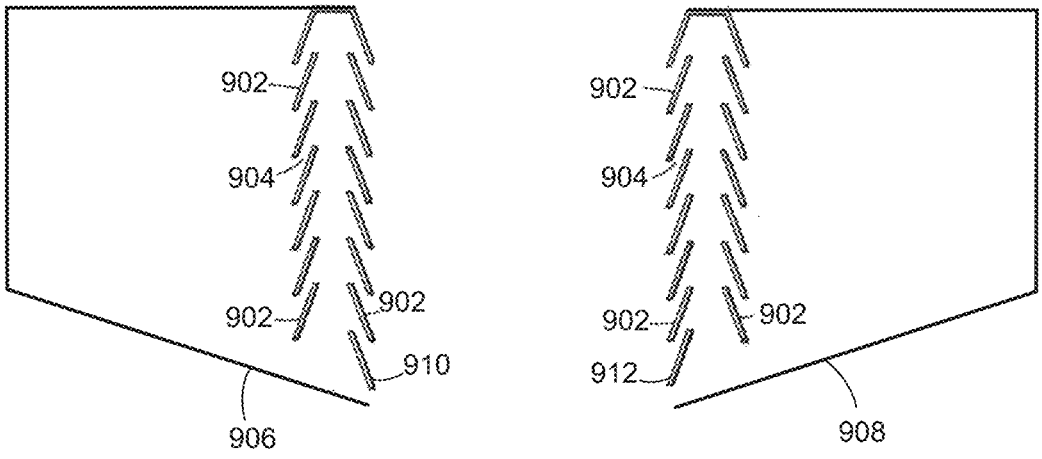
FIG. 9 is a sectional side view of an air pervious portion of a dryer according to another example.

Alternatively, the air pervious side may be formed of louvers 902 as shown in FIG. 9. The louvers 902 are spaced apart to provide passages 904 between adjacent louvers to facilitate the flow of sweep gas between the louvers 902. The louvers 902 are inclined such that bulk solids abut the face of the louvers 902 and slide down the steeply inclined faces. The bulk solids are thus inhibited from passing through.

A bottom 906 of each of the first sweep gas plenums 250, 251, 252, 253 may be sloped downwardly toward a center of the housing. The sloped bottom 906 facilitates the flow of bulk solids out of the first sweep gas plenums 250, 251, 252, 253. Similarly, a bottom 908 of each of the second gas plenums 254, 255, 256, 257 may be sloped downwardly toward a center of the housing. The sloped bottom 908 facilitates the flow of bulk solids out of the second gas plenums 254, 255, 256, 257. A respective bottom one 910 of the louvers 902 on the side of each first sweep gas plenum 250, 251, 252, 253 is spaced from the respective bottom 906 of the first sweep gas plenum 250, 251, 252, 253 to facilitate the flow of bulk solids past the louvers 902 and out of the first sweep gas plenum 250, 251, 252, 253 when the air flow is reversed. Similarly, a respective bottom one 912 of the louvers 902 on the side of each second sweep gas plenum 254, 255, 256, 257 is spaced from the respective bottom 908 of the second sweep gas plenum 254, 255, 256, 257 to facilitate the flow of bulk solids out past the louvers 902 and out of the second sweep gas plenum 254, 255, 256, 257 when the air flow is reversed.

Figure 10:
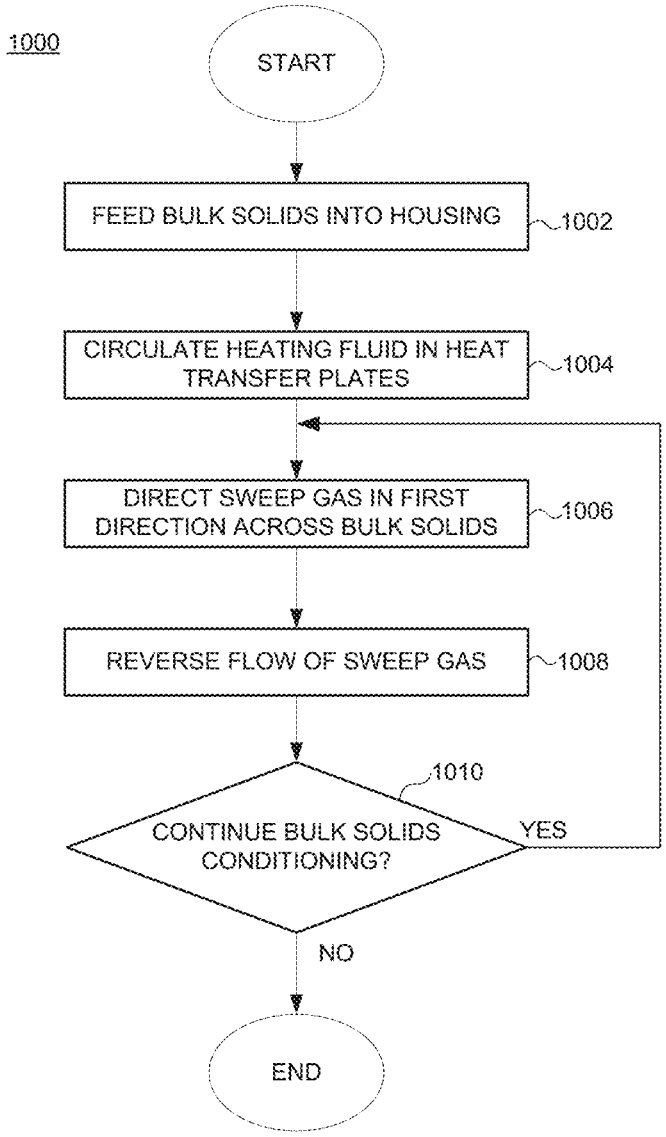
FIG. 10 is a simplified flow chart illustrating a method of drying or conditioning bulk solids.

Referring to FIG. 10 with continued reference to FIG. 2 through FIG. 9. FIG. 10 shows a flow chart illustrating a method of drying or conditioning bulk solids. The method is indicated generally by the numeral 1000. The method may contain additional or fewer processes than shown and described, and parts of the method may be performed in a different order. Bulk solids are fed into the housing 202 through the inlet 204 at 1002 and the bulk solids flow downwardly, as a result of the force of gravity, from the inlet 204 into the hopper 238. The hopper 238 facilitates distribution of the bulk solids to the top bank 220 of the heat transfer plates 208. The bulk solids flow through the spaces between the heat transfer plates 208, toward the outlet 206. Bulk solids that contact the heat transfer plates 208 are deflected into the spaces adjacent the heat transfer plates 208.

As bulk solids flow through the spaces between adjacent heat transfer plates 208 of the banks 220, 222, 224, 226, heating fluid is circulated through the heat transfer plates 208 at 1004 and the bulk solids are indirectly heated as the heat from the heating fluid in the heat transfer plates 208 is transferred to the bulk solids.

Sweep gas enters the sweep gas plenums and is directed across the direction of flow of the bulk solids at 1006 to remove moisture or volatiles from the solids as the solids are heated by indirect heating from the heat transfer plates 208. In the present example, the four-port valves 262, 268, 274, 276 are each in the first flow control configuration in which the sweep gas flows in a first direction. Thus, the sweep gas enters each first sweep gas plenum 250, travels across the housing 202 via the spaces between the heat transfer plates 208 out the second sweep gas plenums 252. After a period of time, the direction of flow of the sweep gas is reversed at 1008 by switching the four-port valves 262, 268, 274, 276 to the second flow control configuration in which the sweep gas flows in the second direction, opposite to the first direction.

The direction of flow of the sweep gas is switched at 1008. As the bulk solids feed continues and thus the drying or conditioning of bulk solids continues at 1010, the direction of flow of the sweep gas is repeatedly switched. Thus, the sweep gas direction is repeatedly changed at 1006 and 1008 at regular intervals in time. Thus, the flow of sweep gas is directed in the first direction and then reversed by directing the flow in the second direction at regular intervals in time. The valves that are utilized to control the direction of flow of the sweep gas are therefore regularly switched between the first flow control configuration and the second flow control configuration.

Alternatively, the four-port valves 262, 268, 274, 276 may be in different configurations. For example, the sweep gas may flow in the first direction, into the housing 202, between the heat transfer plates 208 of the top bank 220, and out of the housing 202 while the sweep gas flows in the second direction, opposite the first direction into the housing 202, between the heat transfer plates 208 of the second bank 222. Similarly, the sweep gas may flow in the first direction into the housing 202, between the heat transfer plates 208 of the third bank 224, and out of the housing 202 while the sweep gas flows in the second direction, opposite the first direction, into the housing 202, between the heat transfer plates 208 of the bottom bank 226. In this example, the banks of plates are spaced apart vertically by a sufficient distance to reduce the chance of sweep gas short-circuiting the travel across the housing by travelling generally vertically.

The bulk solids then flow into the discharge hopper 218, where the bulk solids are discharged under a "choked" flow.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. An apparatus for drying or conditioning bulk solids, the apparatus comprising:

a housing including an inlet for receiving the bulk solids, and an outlet for discharging the bulk solids;

a plurality of spaced apart heat transfer plates assemblies disposed in the housing between the inlet and the outlet for passage of the bulk solids that flow from the inlet, through spaces between the heat transfer plates;

a sweep gas delivery system for the flow of sweep gas in a first direction across the direction of flow of the bulk solids, the sweep gas delivery system including at least one valve for reversing the flow of the sweep gas from the first direction to a second direction, opposite to the first direction.

2. The apparatus according to claim 1, wherein each of the heat transfer plates includes a fluid inlet and a fluid outlet for the flow of a heating fluid through the heat transfer plates.

3. The apparatus according to claim 2, wherein each of the heat transfer plates comprises a pair of metal sheets that are coupled together and include at least one passage between the metal sheets for the flow of the heating fluid through the heat transfer plates.

4. The apparatus according to claim 2, wherein the pair of metal sheets are joined together at a plurality of spaced apart locations to facilitate flow of the heating fluid through the heat transfer plate.

5. The apparatus according to claim 1, wherein the sweep gas delivery system includes a sweep gas source coupled to the at least one valve for the supply of sweep gas in the first direction through the housing and in the second direction through the housing.

6. The apparatus according to claim 5, wherein the sweep gas delivery system includes a sweep gas draw coupled to the at least one valve to draw the sweep gas out of the housing.

7. The apparatus according to claim 6, wherein the at least one valve is coupled to opposing sides of the housing for controlling flow of sweep gas through the housing.

8. The apparatus according to claim 6, wherein the at least one valve is coupled to opposing sides of the housing for controlling flow of sweep gas in the first direction in which the sweep gas flows generally from a first one of the opposing sides to a second one of the opposing sides when the at least one valve is in a first flow control configuration, and for the reversal of the direction of flow of sweep gas such that the sweep gas flow in the second direction, generally from the second one of the opposing sides to the first one of the opposing sides when the at least one valve is in a second flow configuration.

9. The apparatus according to claim 8, wherein the sweep gas delivery system includes a first sweep gas plenum having a first air pervious side at the first one of the opposing sides of the housing and coupled to the at least one valve, and a second sweep gas plenum having a second air pervious side at the second one of the opposing sides of the housing and coupled to the at least one valve.

10. The apparatus according to claim 9, wherein said first air pervious side comprises spaced apart wedge wire or louvers to inhibit the flow of bulk solids into the first sweep gas plenum and the second air pervious side comprises spaced apart wedge wire or louvers to inhibit the flow of bulk solids into the second sweep gas plenum.

11. The apparatus according to claim 6, wherein the at least one valve comprises a 4-port valve including a first port coupled to a first side of the housing, a second port coupled to a second side of the housing, opposite to the first side of the housing, a third port coupled to the sweep gas supply, and a fourth port coupled to the sweep gas draw.

12. The apparatus according to claim 1, wherein the first direction is generally parallel to the heat transfer plates for the flow of sweep gas between the heat transfer plates.

13. The apparatus according to claim 1, wherein the plurality of spaced apart heat transfer plates are arranged in banks including a first bank of spaced apart heat transfer plates disposed in the housing between the inlet and the outlet and a second bank of spaced apart heat transfer plates disposed in the housing between the first bank and the outlet.

14. The apparatus according to claim 13, wherein the sweep gas delivery system comprises a first pair of sweep gas plenums associated with the first bank to facilitate the flow of sweep gas across the direction of flow of the bulk solids as the bulk solids pass through the spaces between the heat transfer plates of the first bank and a second pair of sweep gas plenums associated with the second bank to facilitate the flow of sweep gas across the direction of flow of the bulk solids as the bulk solids pass through the spaces between the heat transfer plates of the second bank.

15. The apparatus according to claim 14, wherein the sweep gas delivery system comprises valves, at least one valve associated with respective pairs of sweep gas plenums such that each bank of heat transfer plates is associated with at least one respective valve configured to switch the direction of flow of the sweep gas between the first direction and the second direction.

16. A method of drying or conditioning bulk solids, the method comprising:

introducing the bulk solids into an inlet of a housing through which the bulk solids flow through spaces between spaced apart heat transfer plates;

subjecting the bulk solids to heating utilizing the heat transfer plates as the bulk solids flow, by the force of gravity, through the spaces between the heat transfer plates, toward an outlet of the housing;

directing a sweep gas through the bulk solids as the bulk solids flow toward the outlet of the housing, the sweep gas being directed to flow in a first direction across the direction of flow of the bulk solids;

reversing direction of flow of the sweep gas by directing the flow of the sweep gas through the bulk solids, in a second direction opposite to the first direction, wherein reversing direction of flow of the sweep gas comprises switching at least one valve to reverse the direction.

17. The method according to claim 16, comprising repeating directing the flow of the sweep gas in the first direction and reversing the flow of the sweep gas by directing flow in the second direction.

18. The method according to claim 16, comprising repeating directing the flow of the sweep gas in the first direction and reversing the flow of the sweep gas by directing flow in the second direction at regular intervals in time, wherein repeating directing the flow of the sweep gas in the first direction and reversing the flow of the sweep gas by directing flow in the second direction at regular intervals in time, comprises regularly switching the at least one valve to control the flow of the sweep gas.

19. The method according to claim 16, wherein subjecting the bulk solids to heating comprises passing heating fluid through the heat transfer plates, the heating fluid indirectly heating the bulk solids as the heating fluid passes within the heat transfer plates.

* * * * *